US006409631B1

(12) United States Patent
Alessandri

(10) Patent No.: US 6,409,631 B1
(45) **Date of Patent: *Jun. 25, 2002**

(54) VARIABLE CONFIGURATION EXERCISE MACHINE

(75) Inventor: Nerio Alessandri, Longiano (IT)

(73) Assignee: Technogym S.r.l., Gambettola (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/871,906

(22) Filed: Jun. 12, 1997

(30) Foreign Application Priority Data

Jun. 11, 1996 (IT) ..... BO96A0325

(51) Int. Cl.[7] ..... A63B 24/00; A63B 21/005

(52) U.S. Cl. ..... 482/4; 482/5; 482/908

(58) Field of Search ..... 482/1, 3, 4, 5, 482/8, 900–902, 908, 142, 133; 297/217.3; 434/247

(56) References Cited

U.S. PATENT DOCUMENTS

| | | | | | |
|---|---|---|---|---|---|
| 4,711,450 | A | * | 12/1987 | McArthur | 482/5 |
| 4,872,670 | A | | 10/1989 | Nichols | |
| 4,907,795 | A | * | 3/1990 | Shaw et al. | 482/9 |
| 4,944,554 | A | * | 7/1990 | Gross et al. | 297/284 |
| 5,214,360 | A | * | 5/1993 | Gonser | |
| 5,230,673 | A | * | 7/1993 | Maeyama et al. | 482/900 X |
| 5,403,251 | A | | 4/1995 | Belsito et al. | |
| 5,645,513 | A | * | 7/1997 | Haycocy et al. | 482/3 X |
| 5,704,875 | A | * | 1/1998 | Tanabe | 482/901 X |
| 5,785,631 | A | * | 7/1998 | Heidecke | 482/4 X |
| 6,024,675 | A | * | 2/2000 | Kashiwaguchi | 482/4 |

FOREIGN PATENT DOCUMENTS

| | | |
|---|---|---|
| EP | WO 91/07214 | 5/1991 |
| EP | 0 442 627 A2 | 8/1991 |
| EP | WO 91/12786 | 9/1991 |
| WO | 94/10634 | 5/1994 |

* cited by examiner

*Primary Examiner*—Denise M. Pothier
(74) *Attorney, Agent, or Firm*—Arent Fox Kintner Plotkin & Kahn

(57) ABSTRACT

An exercise machine with a variable configuration of a type that includes at least one posture portion and one machine portion. The exercise machine includes a reader to read a portable medium constituting a device for storage of protocol data of a user and/or an exercise, a motor-driven adjuster for adjusting a relative position between the posture portion and the machine portion, and a control device, connected to the reader and to the motor-driven adjuster, designed to change the relative position between the posture portion and the machine portion in accordance with the protocol data.

39 Claims, 2 Drawing Sheets

VARIABLE CONFIGURATION EXERCISE MACHINE

BACKGROUND OF THE INVENTION

The present invention relates to a variable configuration exercise machine, that is to say, an exercise machine that can be adjusted in accordance with the characteristics of the user and/or exercises performed by the user on the machine.

For the performance of physical activities such as, for example, different types of exercises in gymnasiums, rehabilitation centers and similar locations, the traditional type of devices, such as barbells, dumb-bells, etc., have been coupled to more complex exercise machines and correlated to their use.

The latter envisage a basic frame to which means are connected for physical effort by the user, such as for example a bar or handles or levers, connected to a load that supplies a resistance to the physical effort.

The user sits on a seat or other support (a bench for example) and from this position the user performs a series of exercises tailored to the type of sport or rehabilitative movement performed.

Currently the seat can be adjusted by the user, for example in height, so that the distance between the seat and bar or handles can be suitably changed. Basically this adjustment is a manual one and must be carried out each time in accordance with a change of exercise or for a different user.

This characteristic can considerably affect the positive effects of the exercises because in order to perform the excerises properly the seat must be adequately positioned (or other machine parts that are also adjustable, such as levers) in accordance with the individual's measurements. For this reason an instructor may need to follow different phases of a training session step by step in order to explain to the user how to keep correct posture while performing the exercises. This also holds true if the same user performs different exercises with the same machine.

Moreover, having to adjust the seat or other exercise machine parts may be a nuisance, especially bearing in mind that gym activities are usually recreational and relaxing activities.

SUMMARY OF THE INVENTION

These and other aims are all achieved by the present invention which provides an exercise machine designed to position the machine in its most suitable configuration for performing an exercise both automatically and by means of reading data relative to the user and/or the exercises to be performed, the data memorized on a portable medium.

One of the advantages of the present invention is that the machine is self-adjusting, thanks to the fact that specific protocol data are linked with a specific user and/or a specific exercise (or series of exercises), so that the machine adapts the relative positioning between its posture portion and its machine portion in accordance with a specific protocol relative to the user and/or to the exercise to be performed.

BRIEF DESCRIPTION OF THE DRAWINGS

Further characteristics and advantages of the invention are apparent from the detailed description which follows, with reference to the accompanying drawings, which illustrate preferred embodiments of the invention by way of example and in which.

DESCRIPTION OF THE PREFERRED EMBODIMENTS

Figure 1:
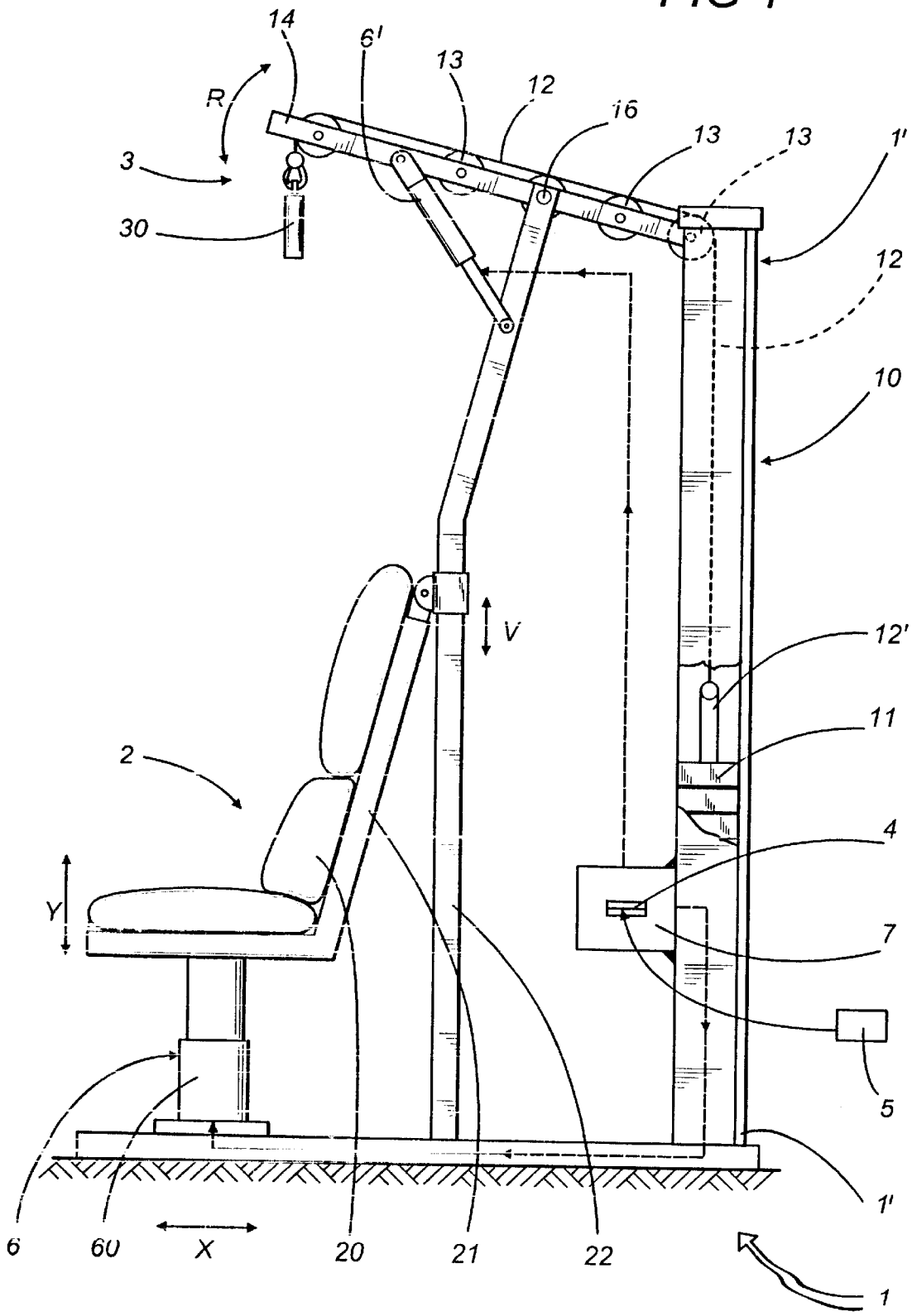
FIG. 1 is a side view of an embodiment of the present invention, in which an exercise machine is shown with parts cut away and portions shown schematically or by blocks.

With reference to FIG. 1, the numeral 1 indicates an exercise machine that comprises a basic structure 1' fitted with a seat 20 for the user and a vertical guide 10 designed to slide a counter-weight consisting of a series of small bricks 11 connected, by means of a chain or belt or cable 12 that passes through one or more pulleys 13, to a bar or hand bar 30 that is gripped by the user to perform work generated by lifting the small bricks 11 and by their sliding along the guide 10.

Therefore the exercise machine can be schematized in a posture portion 2 designed to allow the positioning of a user and which, in the preferred embodiment described here, consists basically of the seat 20, and a machine portion 3 which is represented by the hand bar 30. In other words, the hand bar 30 provides appropriate action means that can be used by the user to exert an effort designed to contrast, for the execution of the exercise, the resistance offered by the exercise machine by means of a load created by the small bricks 11. In this embodiment, the hand bar 30 can also be referred to as a movement device. The small bricks 11 can be referred to as a resisting portion.

The exercise machine includes means 4 for reading a portable medium 5 constituting a data storage device, fitted with a portable memory designed to store the data relative to the user and/or the exercise to be performed.

The portable medium 5 can be of the type called "smart card", that is to say it can be fitted with an electrically erasable programmable read-only type memory ($E^2$PROM).

The medium 5 can be of the type without the need for contacts and, moreover, can consist of a waterproof enclosure that contains a memory programmed through magnetic induction.

A motor-driven adjuster 6 is envisaged on the exercise machine 1 for adjusting the relative position between the posture portion 2 and the machine portion 3. The adjuster is represented in FIG. 1, by way of example only, by a piston 60 that can be extended in height so as to move the seat 20 at least along a vertical direction Y.

In particular, according to the specific embodiment illustrated, the seat 20 is supported by a mobile structure 21, which slides in two ways on a vertical upright 22, according to a direction labelled V in the figure.

Obviously, with modifications for production purposes, a movement can be envisaged even along a horizontal direction X or in another direction by means of devices that are not shown in the figure.

Moreover, a controller connected to the reader means 4 and to the motor-driven adjuster 6 are present, designed to change the relative position between the posture portion 2 and the machine portion 3 in accordance with the protocol data stored on the medium 5. In other words, the exercise machine 1 can move the seat 20 in accordance with the size of the user and/or the exercise he/she must perform.

Alternatively or in addition to the movement of the posture portion 2, a movement of the machine portion 3 can be envisaged, so as to obtain in any case an adjustment of the relative position between the two portions 2 and 3. In the embodiment shown in FIG. 1, a motor-driven adjuster 6' is envisaged consisting of a piston arranged and operating between the basic structure 1' of the machine and an end portion 14 of the machine that supports the hand bar 30 and that is pivoted on the basic structure 1' itself, around a horizontal axis 16. After the motor-driven means 6' are enabled, the end portion 14, and the hand bar 30 supported by the end portion, can be moved in accordance with a rotation labelled R in FIG. 1, so as to obtain a backward and forward movement between the posture portion 2 and the machine portion 3.

The controller 7 can be connected to the motor-driven adjuster 6 through different kinds of transmission means; for example, electric conductors or electromagnetic waves such as radio waves, infrared, etc.

A remote control transmission system can be used even between the controller 7 and the reader 4.

Figure 2:
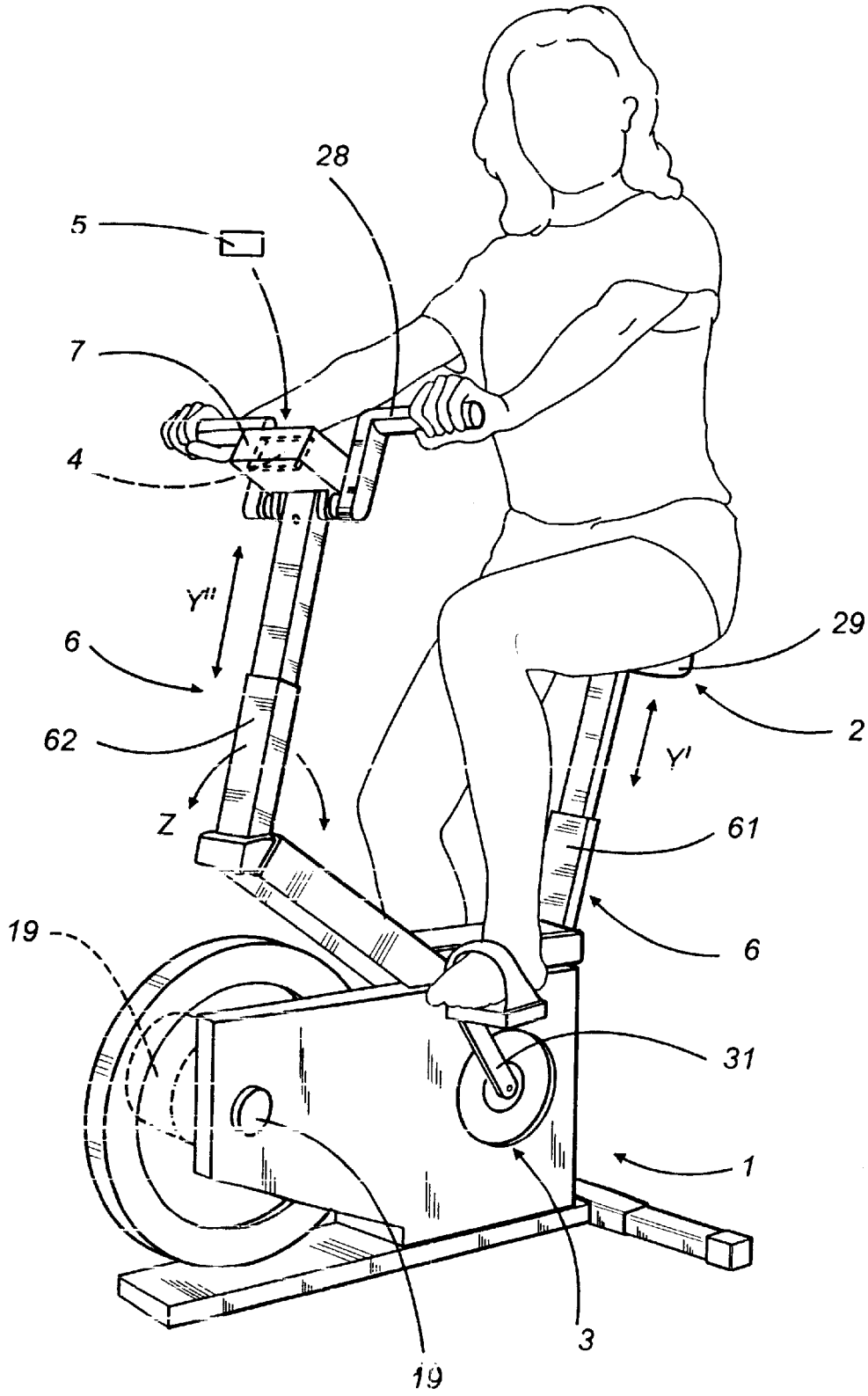
FIG. 2 is a schematic side view of another embodiment of the present invention.

In the embodiment of FIG. 2, the exercise machine 1 is represented by an exercise bike, in which the posture portion 2 is represented by a saddle 29 and by a handle-bar 28 while the machine portion is represented by pedals 31, connected to an electromagnetic type resistance 19 (electric motor, alternator). In the embodiment, the pedals 31 can also be referred to as a movement device. The resistance 19 can be referred to as a resisting portion.

In this solution, the motor-driven adjuster consist of variable extension elements 61 and 62 envisaged at the support rods of the saddle 29 and handle-bar 28. These variable extension elements can move the saddle 29 and the handle-bar 28 at least in accordance with the substantially vertical directions labelled Y' and Y". Moreover, in the embodiment in FIG. 2, an adjustment is envisaged in accordance with the rotation labelled z of the rod of the handle-bar 28.

In addition to the aforementioned adjustments, an adjustment of the machine load can be envisaged. This operation is simplified in those cases in which the machine resistance can be obtained electrically. In fact, by entering parameters relative to the resistance to offer to the user, among the protocol data stored in the portable medium 5, it is also possible to change the resistance parameters in accordance with the user and/or the exercises. For example, when using an alternator, as shown schematically by the numeral 19 in FIG. 2, simply change the value of the resistance supplied by the alternator 19 electrically.

For production purposes, with appropriate modifications the load can also be changed in an exercise machine in which, as in the embodiment in FIG. 1, the resistance is offered with mechanical type solutions.

For example, a selecting device may be envisaged designed to group the small bricks 11 on the relative pin 12' automatically, in accordance with the data read by the reading means 4 and relative, in particular, to the performance techniques of the exercise. In other words, the device allows the changing of the total load consisting of a sum of the small bricks that constitute a so-called weight pack.

In conclusion, with the present invention an exercise machine is obtained that is able to personalize its configuration in accordance with the person utilizing the machine and the exercise to be performed on it, with changes that substantially can be dimensional or that also concern the resistance value offered to the user. The present invention, thus designed for the said objects, may be subject to numerous modifications and variations, all encompassed by the original design concept. Moreover, all components may be replaced with technically equivalent parts.

What is claimed is:

1. An exercise machine with a variable configuration, comprising:

a posture portion;

a machine portion including a movement device and a resisting portion, the movement device being connected to the resisting portion, which provides a resisting force to the movement device, when using the exercise machine, a user applies a force to the movement device, the force being against the resisting force provided to the movement device;

a reader to read a portable medium that constitutes a data storage device with a memory to store data relative to at least one physical measurements of the user and an exercise;

at least one motor-driven adjuster being connected to posture portion, to adjust a relative position between the posture portion and the machine portion;

a controller, connected to the reader and to the motor-driven adjuster, to activate, independently and in a self adjusting manner, the motor-driven adjuster to move the posture portion along at least one direction so as to change the relative position between the posture portion and the machine portion based only on the data stored in the memory of the storage device of the portable medium; and a load adjuster to adjust the resisting force provided to the movement device by changing a load in accordance with the exercise to be performed, the load adjuster being connected to the controller and being configured to change the resisting force provided to the movement device in accordance with the data stored in the portable medium.

2. The exercise machine according to claim 1, wherein the motor-driven adjuster is connected to and operates at least the posture portion.

3. The exercise machine according to claim 2, wherein:

the posture portion includes at least one seat, and the motor-driven adjuster is configured to move the at least one seat at least bidirectionally along a direction toward and away from the machine portion.

4. The exercise machine according to claim 1, wherein the motor driven adjuster is connected to and operates at least the machine portion.

5. The exercise machine according to claim 1, wherein the at least one motor-driven adjuster comprises a plurality of motor driven adjusters, a first motor driven adjuster is connected to and operates the posture position and a second motor-driven adjuster is connected to and operates the machine portion.

6. The exercise machine according to claim 1, further comprising a portable medium having memory, wherein the memory of the portable medium is stored on the portable medium.

7. The exercise machine according to claim 1, further comprising a portable medium having memory, wherein the portable medium is fitted with an electrically erasable programmable read-only memory.

8. The exercise machine according to claim 1, further comprising a portable medium having memory, wherein the portable medium comprises a waterproof enclosure that includes the memory programmed through magnetic induction.

9. The exercise machine according to claim 1, wherein the controller comprises a radio wave emitter and a receiver for communicating with the motor-driven adjuster.

10. The exercise machine according to claim 1, wherein the controller comprises an electromagnetic wave emitter and receiver for communicating with the reader.

11. The exercise machine according to claim 1, wherein the load adjuster is configured for adjusting the resisting force provided by the resisting portion to the movement device by combining different weight elements through a relative connector operated by the load adjuster.

12. The exercise machine according to claim 1, further comprising an electrical device connected to the controller, wherein the load adjuster adjusts the resisting force by using the electrical device connected to the controller so as to change the resisting force provided to the movement device in accordance with the data stored on the portable medium.

13. The exercise machine according to claim 12, wherein the electrical device is an alternator.

14. The exercise machine according to claim 12, wherein the electrical device is an electric motor.

15. An exercise machine with a variable configuration, comprising:

a posture portion;

a machine portion including a movement device and a resisting portion, the movement device being connected to the resisting portion, which provides a resisting force to the movement device, when using the exercise machine, a user applies a force to the movement device, the force being against the resisting force provided to the movement device;

a reader to read a portable medium that constitutes a data storage device with a memory for storing data relative to at least one physical measurements of the user and an exercise;

at least one motor-driven adjuster being connected to machine portion, to adjust a relative position between the posture portion and the machine portion; and a controller, connected to the reader and to the motor-driven adjuster, to activate, independently and in a self adjusting manner, the motor-driven adjuster to move the machine portion along at least one direction so as to change the relative position between the posture portion and the machine portion based only on the data stored in the memory of the storage device of the portable medium.

16. The exercise machine according to claim 15, wherein the motor-driven adjuster is connected to and operates at least the posture portion.

17. The exercise machine, according to claim 16, wherein:

the posture portion includes at least one seat, and the motor driven adjuster is configured to move the at least one seat at least bidirectionally along a direction toward and away from the machine portion.

18. The at least one motor-driven adjuster according to claim 15, wherein the at least one motor-driven adjuster comprises a plurality of motor driven adjusters, a first motor driven adjuster is connected to and operates at the posture position and a second motor-driven adjuster is connected to and operates at the machine portion.

19. The exercise machine according to claim 15, further comprising a portable medium having memory, wherein the memory of the portable medium is stored on the portable medium.

20. The exercise machine according to claim 15, further comprising a portable medium, wherein the portable medium is fitted with an electrically erasable programmable read-only memory.

21. The exercise machine according to claim 15, further comprising a portable medium having memory, wherein the portable medium comprises a waterproof enclosure that includes the memory programmed through magnetic induction.

22. The exercise machine according to claim 15, wherein the controller comprises a radio wave emitter and a receiver for communicating with the motor-driven adjuster.

23. The exercise machine according to claim 15, wherein the controller comprises an electromagnetic wave emitter and receiver for communicating with the reader.

24. The exercise machine according to claim 15, further comprising:

a load adjuster to adjust the resisting force provided to the movement device by changing a load in accordance with the exercise to be performed, the load adjuster being connected to the controller and being configured to change the resisting force provided to the movement device in accordance with the data stored in the portable medium, wherein the load adjuster is configured for adjusting the resisting force provided by the resisting portion to the movement device by combining different weight elements through a relative connector operated by the load adjuster.

25. The exercise machine according to claim 15, further comprising:

a load adjuster to adjust the resisting force provided to the movement device by changing a load in accordance with the exercise to be performed, the load adjuster being connected to the controller and being configured to change the resisting force provided to the movement device in accordance with the data stored in the portable medium; and an electrical device connected to the controller, wherein the load adjuster adjusts the resisting force by using the electrical device connected to the controller so as to change the resisting force provided to the movement device in accordance with the data stored on the portable medium.

26. The exercise machine according to claim 25, wherein the electrical device is an alternator.

27. The exercise machine according to claim 25, wherein the electrical device is an electric motor.

28. An exercise machine with a variable configuration, comprising:

a posture portion;

a machine portion including a movement device and a resisting portion, the movement device being connected to the resisting portion, which provides a resisting force to the movement device, when using the exercise machine, a user applies a force to the movement device, the force being against the resisting force provided to the movement device;

a reader to read a portable medium that constitutes a data storage device with a memory for storing data relative to at least one of physical measurements of the user and an exercise;

a first motor-driven adjuster being connected to the machine portion and a second motor driven adjuster connected to the posture portion, to adjust a relative position between the posture portion and the machine portion; and a controller, connected to the reader and to the first and the second motor-driven adjusters to activate, independently and in a self-adjusting manner, the motor-driven adjusters to move the posture portion and the machine portion along at least one direction so as to change the relative position between the posture portion and the machine portion based only on the data stored in the memory of the storage device of the portable medium.

29. The exercise machine according to claim 28, wherein the first motor-driven adjuster is connected to and operates at least the posture portion.

30. The exercise machine, according to claim 29, wherein:

the posture portion includes at least one seat, and the first motor driven adjuster is configured to move the at least one seat at least bidirectionally along a direction toward and away from the machine portion.

31. The exercise machine according to claim 28, further comprising a portable medium having memory, wherein the memory of the portable medium is stored on the portable medium.

32. The exercise machine according to claim 28, further comprising a portable medium, wherein the portable medium is fitted with an electrically erasable programmable read-only memory.

33. The exercise machine according to claim 28, further comprising a portable medium having a memory, wherein the portable medium comprises a waterproof enclosure that includes the memory programmed through magnetic induction.

34. The exercise machine according to claim 28, wherein the controller comprises a radio wave emitter and a receiver for communicating with the motor-driven adjuster.

35. The exercise machine according to claim 28, wherein the controller comprises an electromagnetic wave emitter and receiver for communicating with the reader.

36. The exercise machine according to claim 28, further comprising:

a load adjuster to adjust the resisting force provided to the movement device by changing a load in accordance with the exercise to be performed, the load adjuster being connected to the controller and being configured to change the resisting force provided to the movement device in accordance with the data stored in the portable medium, wherein the load adjuster is configured for adjusting the resisting force provided by the resisting portion to the movement device by combining different weight elements through a relative connector operated by the load adjuster.

37. The exercise machine according to claim 28, further comprising:

a load adjuster to adjust the resisting force provided to the movement device by changing a load in accordance with the exercise to be performed, the load adjuster being connected to the controller and being configured to change the resisting force provided to the movement device in accordance with the data stored in the portable medium; and an electrical device connected to the controller, wherein the load adjuster adjusts the resisting force by using the electrical device connected to the controller so as to change the resisting force provided to the movement device in accordance with the data stored on the portable medium.

38. The exercise machine according to claim 28, wherein the electrical device is an alternator.

39. The exercise machine according to claim 28, wherein the electrical device is an electric motor.

* * * * *